US010174478B2

(12) United States Patent
Nicolas

(10) Patent No.: US 10,174,478 B2
(45) Date of Patent: Jan. 8, 2019

(54) DEVICE AND METHOD FOR KEEPING WATER AWAY FROM A CONCRETE SLAB SITTING ON A FOOTING

(71) Applicant: Marcel Nicolas, Grande-Rivière (CA)

(72) Inventor: Marcel Nicolas, Grande-Rivière (CA)

( * ) Notice: Subject to any disclaimer, the term of this patent is extended or adjusted under 35 U.S.C. 154(b) by 0 days.

(21) Appl. No.: 14/546,004

(22) Filed: Nov. 18, 2014

(65) Prior Publication Data

US 2015/0107189 A1 Apr. 23, 2015

Related U.S. Application Data

(62) Division of application No. 14/058,840, filed on Oct. 21, 2013.

(51) Int. Cl.
*E02D 31/02* (2006.01)

(52) U.S. Cl.
CPC ..... *E02D 31/02* (2013.01)

(58) Field of Classification Search
CPC ..... E02D 31/02
USPC ..... 52/169.1, 169.14, 250, 259; 405/39, 40, 405/41, 43, 45, 229, 230, 231, 244, 255, 405/256
See application file for complete search history.

(56) References Cited

U.S. PATENT DOCUMENTS 2,378,995 A * 6/1945 Freeman ..... E02D 27/48 405/230
3,304,672 A * 2/1967 Bakke ..... 52/169.5
3,413,769 A * 12/1968 Hoyt ..... 52/198
3,426,487 A * 2/1969 Forte ..... 52/1
3,427,810 A * 2/1969 Petersen ..... 405/43
3,850,193 A * 11/1974 Guzzo ..... 137/362
3,852,925 A * 12/1974 Gazzo ..... 52/302.3
4,075,800 A * 2/1978 Molick ..... 52/169.5
4,136,500 A * 1/1979 DiFiore ..... 52/741.13
4,245,443 A * 1/1981 Beechen ..... 52/169.5
4,265,064 A * 5/1981 Parezo ..... 52/302.3
4,271,648 A * 6/1981 Johnson ..... 52/169.5
4,333,281 A * 6/1982 Scarfone ..... 52/169.5
4,381,630 A * 5/1983 Koester ..... 52/169.5
4,486,986 A * 12/1984 Cosenza ..... 52/169.5
4,538,386 A * 9/1985 DiCello ..... 52/302.3
4,541,479 A * 9/1985 Bergeron, Jr. ..... F24D 11/009 126/400
4,612,742 A * 9/1986 Bevilacqua ..... 52/169.5
4,757,651 A * 7/1988 Crites ..... 52/169.5
4,858,521 A * 8/1989 Heh ..... 454/344
4,898,494 A * 2/1990 Ellis ..... 404/2
5,054,252 A * 10/1991 Newman ..... E02D 31/008 52/169.14

(Continued)

*Primary Examiner* — James M Ference
(74) *Attorney, Agent, or Firm* — Praxis

(57) ABSTRACT

A device and method for keeping humidity/water away from a main concrete slab sitting on a concrete footing of a building includes a joint entirely covering an intersection of the external side surface of the foundation wall and the top surface of the footing, and typically a structural rod located adjacent and along the intersection. Alternatively, the device and method includes at least one through hole extending through the footing, and sloping downwardly from the internal side surface to the external side surface, and below the top surface of the footing, to drain water away from the area under the slab. A drain pipe may also be inserted into the hole.

4 Claims, 4 Drawing Sheets

(56) References Cited

U.S. PATENT DOCUMENTS 5,145,291 A * 9/1992 Bullivant ..... E02D 5/38 405/230
5,158,399 A * 10/1992 Flores ..... 405/285
5,367,842 A * 11/1994 Janesky ..... 52/169.5
5,399,050 A * 3/1995 Jacobus ..... 405/229
5,495,696 A * 3/1996 Repka ..... 52/169.5
5,501,044 A * 3/1996 Janesky ..... 52/169.5
5,535,556 A * 7/1996 Hughes, Jr. ..... 52/169.5
5,630,299 A * 5/1997 Jackman et al. ..... 52/169.5
5,634,311 A * 6/1997 Carlton ..... 52/577
5,694,723 A * 12/1997 Parker ..... E02D 27/32 404/4
5,771,643 A * 6/1998 Parker ..... 52/169.5
5,845,456 A * 12/1998 Read ..... 52/741.11
5,884,439 A * 3/1999 Hess et al. ..... 52/155
5,931,603 A * 8/1999 Swain et al. ..... 405/229
6,132,139 A * 10/2000 Hashimoto et al. ..... 405/104
6,230,468 B1 * 5/2001 Klaus ..... 52/741.11
6,382,237 B1 * 5/2002 Takai ..... 137/236.1
6,561,732 B1 * 5/2003 Bloomfield et al. ..... 405/43
6,598,360 B1 * 7/2003 Pratt ..... 52/169.5
6,619,001 B1 * 9/2003 Pratt ..... 52/169.5
6,634,144 B1 * 10/2003 Moore et al. ..... 52/169.5
6,676,506 B2 * 1/2004 Steneby et al. ..... 454/186
6,766,620 B2 * 7/2004 Robbins ..... E02D 31/10 405/129.5
7,181,888 B1 * 2/2007 Facaros ..... 52/169.5
7,980,035 B1 * 7/2011 D'Apolito et al. ..... 52/302.1
8,186,127 B1 * 5/2012 Pratt ..... 52/741.11
8,297,005 B1 * 10/2012 Bramble ..... E02D 31/002 52/169.5
8,312,682 B2 * 11/2012 Trotter ..... 52/302.6
2002/0096881 A1 * 7/2002 DeSanto, Sr. ..... 285/192
2002/0152696 A1 * 10/2002 Ruiz et al. ..... 52/169.5
2002/0154951 A1 * 10/2002 Gamache ..... 405/43
2002/0187005 A1 * 12/2002 Le Blanc ..... 405/36
2003/0115814 A1 * 6/2003 Nielsen ..... 52/302.1
2003/0219315 A1 * 11/2003 Adams ..... 405/229
2004/0076473 A1 * 4/2004 Burkhart ..... 405/36
2005/0196577 A1 * 9/2005 Riste ..... E02D 31/02 428/76
2005/0218270 A1 * 10/2005 Doverspike ..... 248/65
2006/0096186 A1 * 5/2006 Safie ..... 52/169.5
2006/0096204 A1 * 5/2006 Martens et al. ..... 52/293.3
2006/0112653 A1 * 6/2006 Hogenson ..... 52/169.5
2008/0295439 A1 * 12/2008 Janesky ..... 52/589.1
2012/0102851 A1 * 5/2012 Scarfo ..... 52/169.5
2013/0175427 A1 * 7/2013 Moyher ..... 249/18

* cited by examiner

DEVICE AND METHOD FOR KEEPING WATER AWAY FROM A CONCRETE SLAB SITTING ON A FOOTING

CROSS REFERENCE TO RELATED APPLICATIONS

The present patent application is a division of parent U.S. patent application Ser. No. 14/058,840 filed on Oct. 21, 2013, which is included herein by reference.

FIELD OF THE INVENTION

The present invention relates to concrete foundations, and more specifically to a device and method for keeping humidity/water away from a main concrete slab sitting on a footing.

BACKGROUND OF THE INVENTION

The accumulation of water, and sometimes water pressure (hydra-pressure), under a concrete slab of a building can generate major problems to the building structure, without accounting for discomforts the building resident has to deal with. Water under a concrete slab, usually considered as the basement floor of the building, causes a high level (higher than normal comfortable level) of moisture, which might eventually dampen sections of the floor finishing and/or lower regions of walls. Other problems may occur on the concrete foundation itself. All these problems are even more present when there is a positive pressure (hydro-pressure) under the slab.

Such water can be stagnant and remain under the slab for extensive periods of time, if not permanently, depending on the soil type. Since there is no real access under the slab, there is no efficient way to get rid of the above-mentioned problems associated with the presence of water or moisture, other than breaking the slab to access the soil underneath. Alternatively, some have tried to drain such water by reaching the area from underneath the footing, but this could induce local displacement (collapsing, falling) of the footing, which will generate even more problematic situations to the structure of the building.

Humidity can also reach the concrete slab from the interface between the foundation walls and the footing supporting the walls, with the concrete of the foundation walls not fully adhering to the footing, thereby leaving some interstices for water to reach the slab. Furthermore, since the concrete is known to be somewhat porous, it is further easy for water often accumulating at the outer periphery of the footing to slowly flow along the unsealed interface and reach the slab sitting on the inner periphery of the footing. Water easily enters the intersection when accumulated onto the top surface of the footing. This is especially the case when the external top surface of the footing is slightly inclined downwardly towards the foundation wall.

Accordingly, there is a need for an improved device and method for keeping humidity away from a main concrete slab.

SUMMARY OF THE INVENTION

It is therefore a general object of the present invention to provide an improved device and method for keeping humidity away from a main concrete slab.

An advantage of the present invention is that the device/method prevents the water/humidity from entering the intersection between the footing and the foundation wall sitting thereon and reaching the main concrete slab.

Another advantage of the present invention is that the device/method allows the water to move away from the concrete slab through a plurality of drain pipes extending through openings into the footing from an area under the slab to an area exterior to the footing, while preferably preventing water from entering into the pipes and flowing back towards the slab.

A further advantage of the present invention is that the device/method allows for the drainage of water accumulated, and typically pressurized, under an existing concrete slab without having to break or damage the slab, as well as for the continuous drainage of future water reaching the area under the slab, such as after a heavy rain fall or the like.

Still another advantage of the present invention is that the device/method allows for an air venting of the area under the slab after any water has been drained away.

Yet another advantage of the present invention is that the device/method is preferably retrofitted into an already existing building or could eventually installed during construction phase of a new building under-ground foundation.

According to an aspect of the present invention there is provided a device for keeping humidity away from a main concrete slab partially sitting on an edge of a top surface of a footing and adjacent a foundation wall entirely sitting on the top surface of the footing, the foundation wall having an external side surface facing away from the slab and an internal side surface facing towards the slab, the top surface having an external protrusion thereof extending externally away from the external side surface, said device comprising:

- a substantially solid joint adapted to be located adjacent and along an intersection of the external side surface of the foundation wall and the top surface of the footing, the joint entirely and sealably covering the intersection, and adapted to cover a first portion of the external side surface adjacent the intersection and a portion of the external protrusion adjacent the intersection, said joint defining a free surface angled relative to both the first side surface and the top surface, in a cross section of the device, the free surface, the first portion of the external side surface and the portion of the external protrusion forming a substantially triangular shape;
- wherein the joint closes off the intersection to keep humidity away therefrom and from the concrete slab.

Typically, the device further includes a water resistant membrane adhering to and covering the free surface and at least a second portion of the external side surface adjacent and above the first portion thereof.

Conveniently, the device includes a structural rod adapted to be located adjacent and along the intersection, the structural being entirely covered by the joint.

Conveniently, the device includes a plurality of spacers for spacing the structural rod from the foundation wall and the footing, said plurality of spacers being entirely covered by the joint.

Conveniently, the plurality of spacers are anchors for anchoring the structural rod to foundation wall and the footing.

Conveniently, the joint is made out of settable concrete material.

According to another aspect of the present invention there is provided a method for keeping humidity away from a main concrete slab partially sitting on an edge of a top surface of a footing and adjacent a foundation wall entirely sitting on the top surface of the footing, the foundation wall having an external side surface facing away from the slab and an internal side surface facing towards the slab, the top surface having an external protrusion thereof extending externally away from the external side surface, the external side surface of the foundation wall and the top surface of the footing defining an intersection therebetween, said method comprising the step of:

closing off the intersection to keep humidity away therefrom and from the concrete slab.

Typically, the step of closing off the intersection includes:

entirely covering the intersection with a substantially solid joint, the joint being adapted to cover a first portion of the external side surface adjacent the intersection and a portion of the external protrusion adjacent the intersection, said joint defining a free surface angled relative to both the first side surface and the top surface, in a cross section of the concrete joint, the free surface, the first portion of the external side surface and the portion of the external protrusion forming a substantially triangular shape.

Conveniently, the method further includes, before covering the intersection, the step of installing a structural rod adjacent and along the intersection, and the step of covering the intersection further includes entirely covering the structural rod.

Conveniently, the step of installing a structural rod includes spacing the structural rod from the foundation wall and the footing using a plurality of spacers.

Conveniently, the method of claim 8, further includes, after the step of covering the intersection, the step of covering the free surface and at least a second portion of the external side surface adjacent and above the first portion thereof with a water resistant membrane adhering thereto.

According to another aspect of the present invention there is provided a device for keeping humidity away from a main concrete slab partially sitting on an edge of a top surface of a footing and adjacent a foundation wall sitting on the top surface of the footing, the footing having an external side surface facing away from the slab and an internal side surface facing towards the slab, said device comprising:

at least one through hole extending through the footing from the internal side surface to the external side surface, and below the top surface, the at least one through hole sloping downwardly from the internal side surface to the external side surface;

wherein the at least one through hole allows water to flow therethrough from an interior area located adjacent the internal side surface of the footing and below the concrete slab to an exterior area located adjacent the external side surface of the footing to keep humidity away from the concrete slab.

Conveniently, the at least one drain pipe is received within the at least one through hole, the at least one drain pipe sloping downwardly from the internal side surface to the external side surface, the at least one drain pipe including a plurality of drain holes extending through a wall thereof.

Conveniently, the at least one drain pipe is sealably received within the at least one through hole.

Conveniently, the at least one drain pipe has a pointy inner end thereof extending away from the footing into the interior area.

Conveniently, the at least one drain pipe has an outer end thereof extending away from the footing into the exterior area, said outer end including a check valve so as to prevent any solid and/or fluid from entering into the at least one drain pipe from the outer end.

Conveniently, the outer end is located adjacent the external side surface of the footing.

Alternatively, the at least one drain pipe includes a plurality of longitudinal sections connecting to each other into an end-to-end configuration.

Conveniently, the plurality of longitudinal sections connect to each other into the end-to-end configuration with a screw type manner.

Conveniently, each of the plurality of longitudinal sections includes a plurality of drain holes extending through a wall thereof.

Alternatively, a check valve is located inside the at least one through hole adjacent the external side surface so as to prevent any solid and/or fluid from entering into the at least one through hole from the exterior area.

Conveniently, the device includes a vent pipe extending from the interior area through the footing and along the foundation wall adjacent the external side surface to above a ground level adjacent the foundation wall.

According to another aspect of the present invention there is provided a method for keeping humidity away from an existing main concrete slab partially sitting on an edge of a top surface of an existing footing and adjacent an existing foundation wall sitting on the top surface of the existing footing, the existing footing having an external side surface facing away from the existing concrete slab and an internal side surface facing towards the existing concrete slab, said method comprising the step of:

draining water away from an interior area located adjacent the internal side surface of the existing footing and below the existing concrete slab to an exterior area located adjacent the external side surface of the existing footing to keep humidity away from the existing concrete slab.

Typically, the step of draining water includes drilling at least one through hole extending through the existing footing from the internal side surface in fluid communication with the interior area to the external side surface in fluid communication with the exterior area, the at least one through hole sloping downwardly from the internal side surface to the external side surface.

Conveniently, the method further includes, after the step of drilling at least one through hole, the step of installing at least one drain pipe through along the at least one through hole of the existing footing from the internal side surface to the external side surface, and below the top surface, with the at least one drain pipe sloping downwardly from the internal side surface to the external side surface.

Conveniently, the step of installing at least one drain pipe includes:

trimming an outer end of the at least one drain pipe extending away from the existing footing into the exterior area adjacent the external side surface; and installing a check valve at the outer end of the at least one drain pipe so as to prevent any solid and/or fluid from entering into the at least one drain pipe from the exterior area.

Conveniently, the method includes, after the step of drilling at least one through hole, the step of installing a check valve inside the at least one through hole adjacent the external side surface so as to prevent any solid and/or fluid from entering into the at least one through hole from the exterior area.

Conveniently, the at least one drain pipe includes a plurality of longitudinal sections connecting to each other into an end-to-end configuration, and wherein the step of installing at least one drain pipe includes:

axially inserting a first one of the plurality of longitudinal sections into the at least one through hole; and connecting a successive one of said plurality of longitudinal sections to a previously inserted one said longitudinal section into an end-to-end configuration, and axially inserting the successive one of the plurality of longitudinal sections into the at least one through hole.

Conveniently, the method further includes the step of installing a vent pipe adapted to vent gas away from the interior area, the vent pipe extending from the interior area through the existing footing and along the existing foundation wall adjacent the external side surface to above a ground level adjacent the existing foundation wall.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

With reference to the annexed drawings the preferred embodiments of the present invention will be herein described for indicative purpose and by no means as of limitation.

Figure 1:
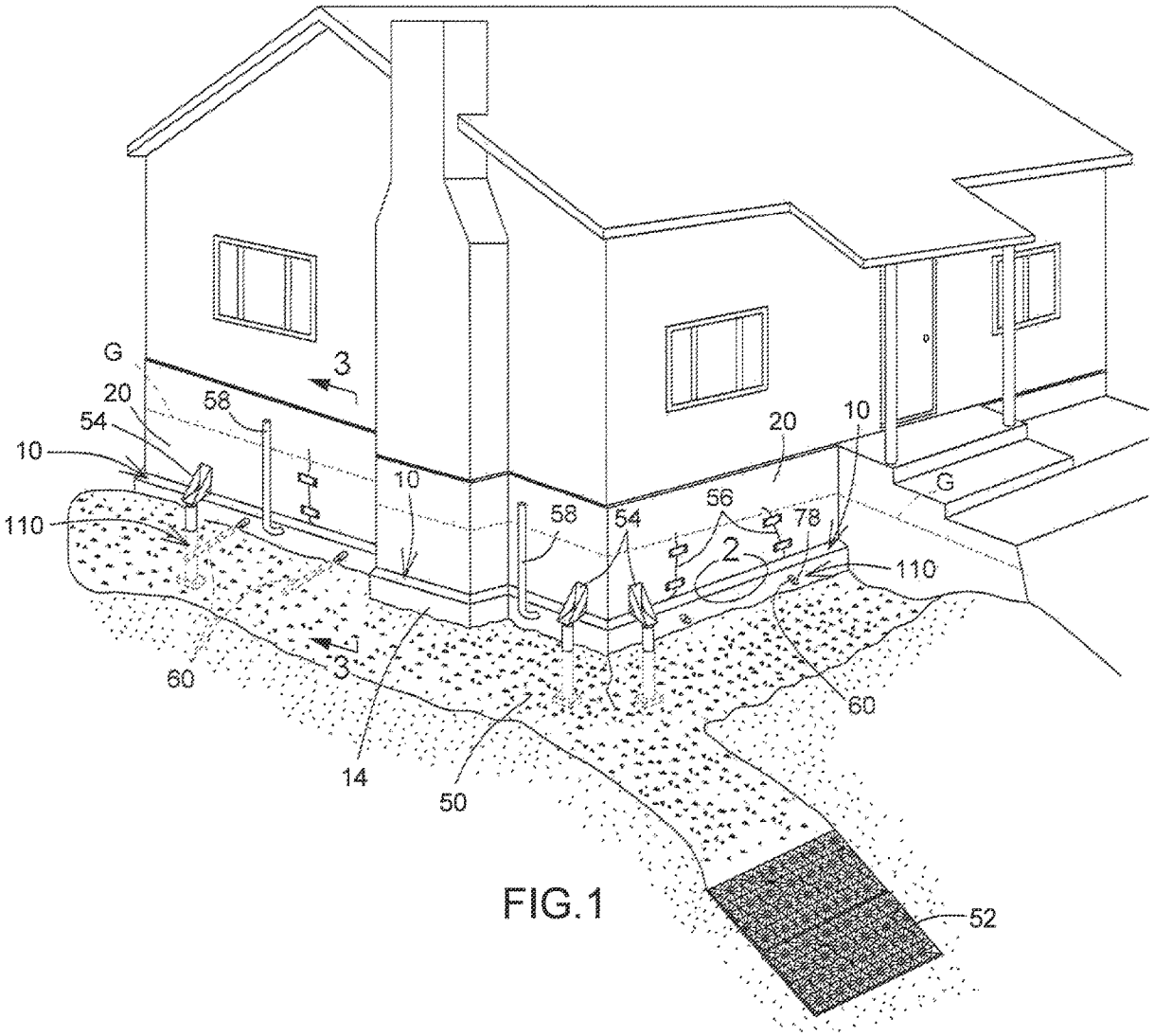
FIG. 1 is a broken perspective view of devices for keeping humidity away from a main concrete slab of a building sitting on a footing in accordance with embodiments of the present invention.
Figure 2:
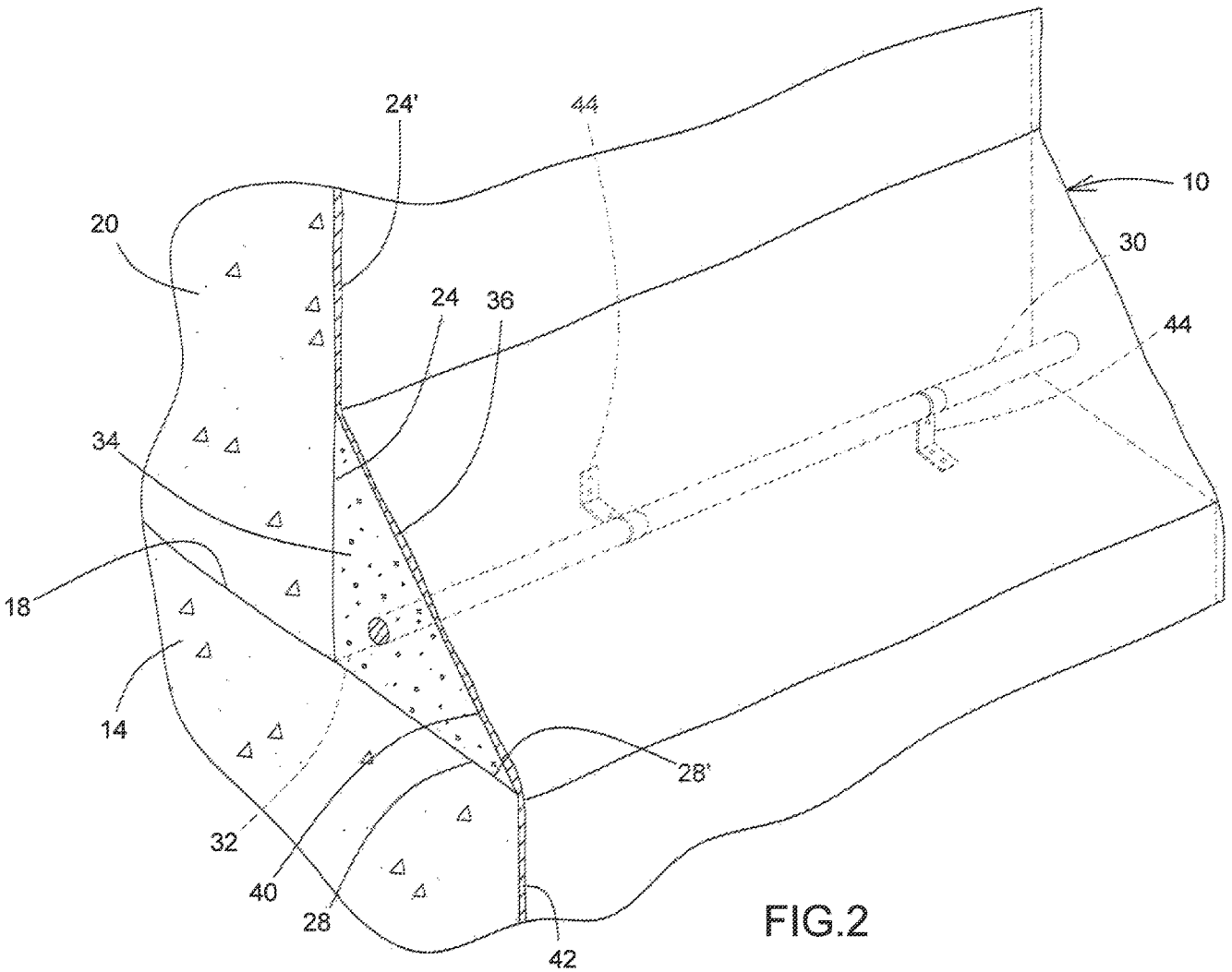
FIG. 2 is an enlarged broken perspective view taken along line 2 of FIG. 1 showing a first embodiment of the present invention.

Referring to FIGS. 1 to 2, there is shown a device 10 for keeping humidity away from a main concrete slab 12 partially sitting on a concrete footing 14 of a building 16 in accordance with an embodiment of the present invention.

The device 10 is essentially for keeping water/humidity away from the main concrete slab 12 partially sitting on an internal edge of a top surface 18 of the footing 14, and adjacent a foundation wall 20 entirely sitting on the top surface 18 of the footing 14, typically with a key 22 at the interface there between to prevent lateral sliding of the foundation wall 20 relative to the footing 14. The foundation wall 20 has an external side surface 24 facing away from the slab 12 and an internal side surface 26 facing towards the slab 12. The top surface 18 of the footing 14 has an external protrusion 28 extending externally away from the external side surface 24 of the foundation wall 20. As shown in FIG. 1, the soil around a portion of the foundation wall 20 has been moved away or digged to leave the foundation wall 20 and a large portion of the footing 14 temporarily exposed to open air during the repairs being done.

The device 10 typically includes substantially solid joint to sealably and entirely cover an intersection 32 of the external side surface 24 of the foundation wall 20 and the top surface 18 of the footing 14. The joint 34 covers a first portion 24' of the external side surface 24 adjacent the intersection 32 and a portion 28 of the external protrusion 28 adjacent the intersection 32, such that it substantially closes off the intersection 32 to keep humidity/water away therefrom and from the concrete slab 12. Typically, the portion 28' is the entire protrusion 28. The concrete joint 34 defines a substantially flat free surface 36 angled relative to both the first side surface 24 and the top surface 18, such that, in a cross section of the device 10, the free surface 36, the first portion 24' of the external side surface 24 and the portion 28' of the external protrusion 28 form together a substantially triangular shape. The angle of the triangular shape between the free surface 36 and the first portion 24' is typically between about 10 and about 80 degrees, and preferably between about 45 and about 80 degrees, and most preferably around 60 degrees.

Typically, the joint 34 also entirely covers a structural rod 30 or the like, such as for example a conventional rebar or metallic cable, located adjacent and along the intersection 32. The joint 34 is preferably made out of settable concrete material that entirely covers the structural rod 30, but could also be made of any other suitable material, such as, for example, a pre-shaped solid foam material that could be adapted to receive the structural rod 30 therein.

Typically, a water resistant membrane 40 adheres to and covers the free surface 36 and at least a second portion 24" of the external side surface 24 adjacent and above the first portion 24' thereof, and preferably a portion of the footing 14 adjacent the free surface 36, such that the membrane 40 typically covers entirely the free surface 36 and its intersections with both the external side surface 24 and the top surface 18, as shown in FIGS. 1 and 2. Preferably, the membrane 40, such as a pulverized or sprayed rubber type material or the like, extends upward along the external side surface 24 of the foundation wall 20 above the ground or soil level G indicated as a dotted line along the foundation wall 20, and downward down to the external side surface 42 of the footing 14.

Typically, the structural rod 30 is spaced from both the foundation wall 20 and the footing 14 via a plurality of spacers 44 or the like, Typically, the spacers are anchors 44 used to hold the structural rod 30 spaced from at least the foundation wall 20, and preferably also from the footing 14. The plurality of anchors 44 are also entirely covered by the concrete joint 34.

The above device 10 can be installed either retroactively onto an existing building or during the construction thereof.

A corresponding method for keeping humidity/water away from the main concrete slab 12 partially sitting on an internal edge of the top surface 18 of a concrete footing 14 and adjacent a foundation wall 20 entirely sitting on the top surface 18 of the footing 14. The method comprises the step of closing off the intersection 32 to keep humidity away therefrom and from the concrete slab 12, which typically includes entirely covering the intersection 32 with a substantially solid joint 34 that defines a free surface 36 angled relative to both the first side surface 24 and the top surface 18.

Typically, the method further includes, before covering the intersection, the step of installing a structural rod 30 adjacent and along the intersection 32, and the step of covering the intersection 32 further includes entirely covering the structural rod 30, with, for example, settable concrete material or pre-shaped foam material or the like.

Typically, the step of installing the structural rod 30 includes spacing the structural rod 30 from the foundation wall 20 and the footing 14 using a plurality of spacers 44, and preferably anchoring the structural rod 30 to at least one of the foundation wall 20 and the footing 14 using a plurality of anchors 44.

The method typically further includes the step of covering the free surface 36 and at least a second portion 24" of the external side surface 24 adjacent and above the first portion 24' thereof with a water resistant membrane 40 adhering thereto.

Now referring more specifically to FIGS. 1, 3, 4*a* and 4*b*, there is shown a device 110 for keeping humidity/water away from a main concrete slab 12 partially sitting on a concrete footing 14 of a building 16 in accordance with another embodiment of the present invention.

The device 110 includes at least one drain pipe 60 adapted to be received within a through hole 62 extending through the footing 14 from an internal side surface 64 thereof facing towards the slab 12 to the external side surface 42, and below the top surface 18. The drain pipe 60 obviously slopes downwardly from the internal side surface 64 to the external side surface 42, to allow water to flow there through, by gravity, from an interior area 66 located adjacent the internal side surface 62 of the footing 14 and below the concrete slab 12 to an exterior area 68 located adjacent the external side surface 42 of the footing 14 to keep humidity/water accumulated just below the concrete slab 12 away therefrom. In some cases, only the through hole 62, being in fluid communication with both the internal 66 and external 68 areas, is enough to drain the water away from the internal area 66.

Typically, the drain pipe 60 is sealably received within the corresponding through hole 62. In order to allow the draining of water, the drain pipe 60 typically includes a plurality of relatively small drain holes 70 extending radially through the wall of the pipe 60, and above a bottom surface 72 of the pipe 60.

In order to ease the insertion of water via the drain pipe 60 into the interior area 66, the drain pipe 60 has a typically pointy or spiky inner end 74, which extends away from the footing 14 into the interior area 66, as the tip of an arrow.

Figure 3:
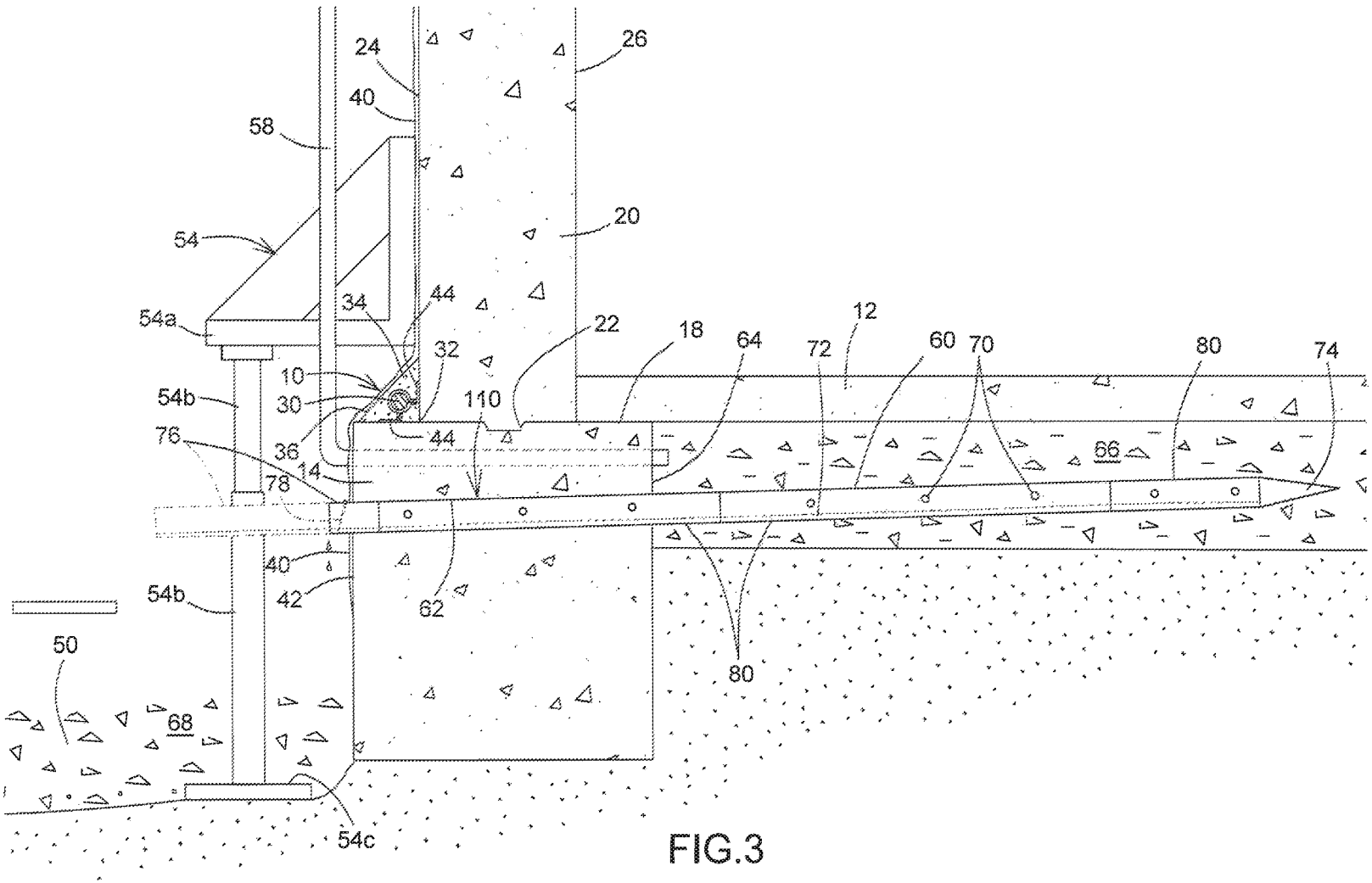
FIG. 3 is an enlarged section view taken along line 3-3 of FIG. 1; showing a second embodiment of the present invention.
Figure 4A:
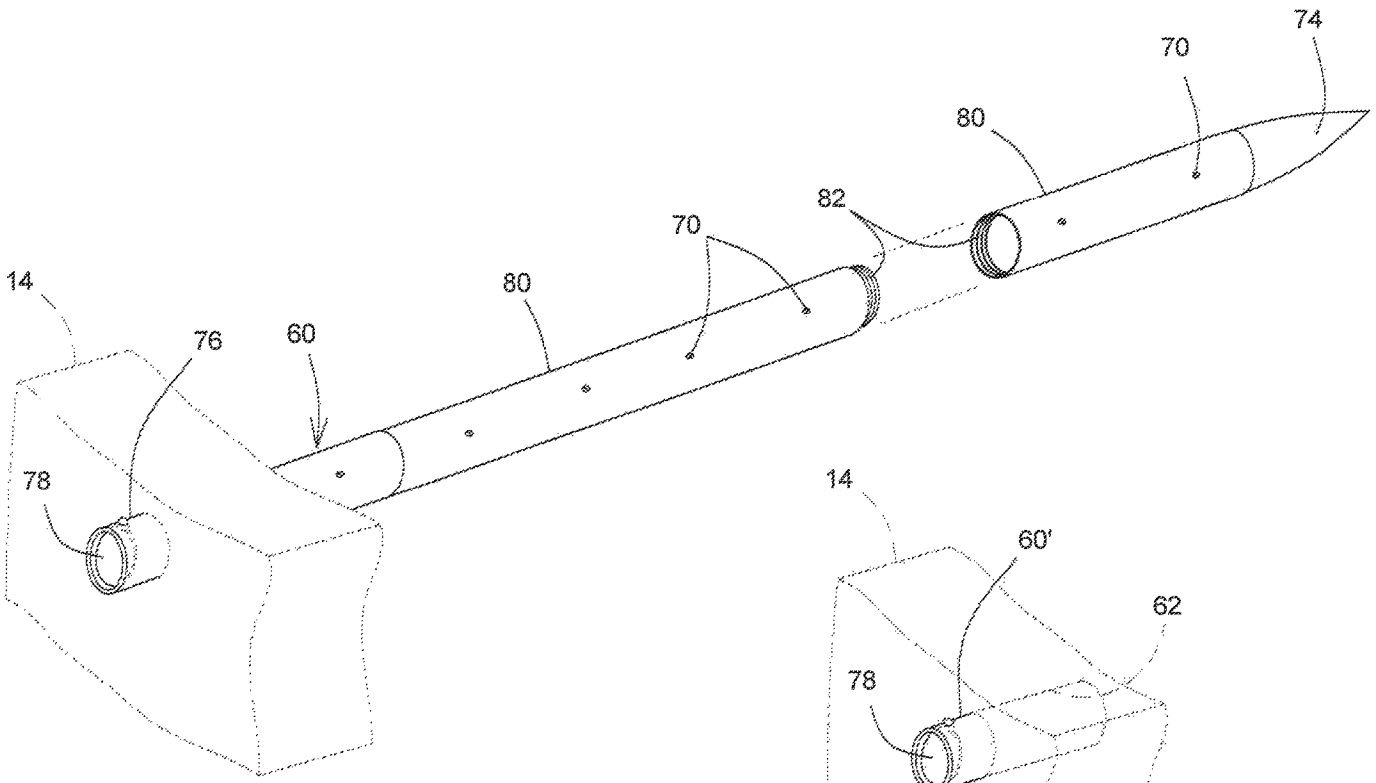
FIG. 4*a* is an enlarged exploded view of the drain pipe of FIG. 3.
Figure 4B:
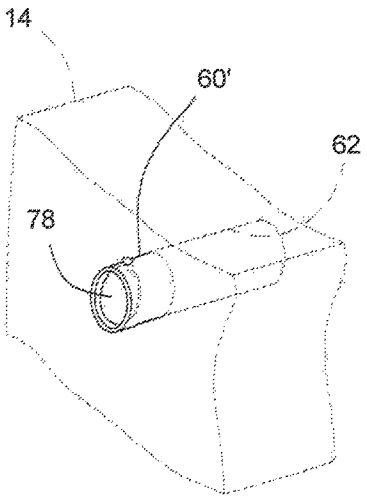
FIG. 4*b* is a view similar to FIG. 4*a*, showing only a check valve installed into the through hole of the footing, without the drain pipe.

During early heavy draining, the outer end 76 of the drain pipe 60, which extends away from the footing 14 into the exterior area 68, is typically spaced from the footing 14 by a predetermined distance of preferably at least about three feet, to help draining the water away from the footing 14, as shown in dotted lines in FIGS. 1 and 3. Just before re-filling the space beside the foundation wall 24, the drain pipe is typically trimmed adjacent the external side surface 42 and closed with a flap/swing-type check valve 78 or the like, in order to prevent any solid and/or fluid from entering into the drain pipe 60 towards the interior area 66. As shown in FIG. 4*b*, when only the through hole 62 is used (without any drain pipe), or after the drain pipe 30 has been removed, the check valve 78 is located in a short pipe 60' inside the through hole 62 adjacent the external side surface 42 to prevent any solid and/or fluid from entering into the through hole 62 from the exterior area 68.

In order to ease the insertion of the drain pipe 60 into the through hole 62, the drain pipe 60 includes a plurality of longitudinal sections 80 connected to each other into an end-to-end configuration, such as with a thread fastening mechanism 82 in a screw type manner, or the like. In such a case, the drain holes 70 are located in each one of the sections 80.

A corresponding method for keeping humidity/water away from the main concrete slab 12 partially sitting on an edge of the top surface 18 of the concrete footing 14 and adjacent the foundation wall 24 sitting on the top surface 18. The method includes the step of draining water away from the interior area 66 located adjacent the internal side surface 64 of the footing 14 and below the concrete slab 12 to the exterior area 68 located adjacent the external side surface 42 of the footing 14 to keep humidity away from the concrete slab 12.

The step of draining water typically includes drilling at least one through hole 62 extending through the footing 14 from the internal side surface 64 in fluid communication with the interior area 66 to the external side surface 42 in fluid communication with the exterior area 68 for receiving the at least one drain pipe 60 therein, with the through hole 62 sloping downwardly from the internal side surface 64 to the external side surface 42, is typically performed.

Before the step of installing at least one drain pipe 60, there is typically the step of installing at least one drain pipe 60 along the through hole 62 of the footing 14 from the internal side surface 64 to the external side surface 42, and below the top surface 18, with the at least one drain pipe 60 sloping downwardly from the internal side surface 64 to the external side surface 42.

Preferably, the step of installing at least one drain pipe 60 includes trimming an outer end 76 of the drain pipe 60 extending away from the footing 14 into the exterior area 68 adjacent the external side surface 42; and installing a check valve 78 at the outer end 76 of the drain pipe 60.

Alternatively, after the step of drilling at least one through hole 62, there is typically the step of installing a check valve 78 inside the through hole 62 adjacent the external side surface 42 to prevent any solid and/or fluid from entering into the through hole 62 from the exterior area 68.

When the drain pipe 60 includes a plurality of longitudinal sections 80 connecting to each other into an end-to-end configuration, the step of installing at least one drain pipe 60 includes axially inserting a first one of the plurality of longitudinal sections 80 into the at least one through hole 62; and connecting a successive one of said plurality of longitudinal sections 80 to a previously inserted one said longitudinal section 80 into an end-to-end configuration, and axially inserting the successive section 60 into the through hole 62.

The method may also include the step of installing a vent pipe 58 adapted to vent gas away from the interior area 66. As shown in FIG. 3, the vent pipe 58 typically extends from the interior area 66 through the footing 14 and along the foundation wall 20 adjacent the external side surface 24 to above the ground level G adjacent the foundation wall 20.

As schematically shown in FIG. 1, the present invention is always preferably installed along with a bed of small rocks 50 surrounding the footing 14 to improve the flow of water away from the building, and also preferably extending down to either a main water reservoir 52 or the like from which the accumulated water can be drained away or a city drain pipe (not shown), When installed retroactively, it is preferable to temporarily increase the support of the building foundations via hydraulic rams assemblies 54 or the like removably secured all around to the foundation walls 20, since the soil is temporarily weakened around the footing 14. Each ram 54 typically includes a bracket 54*a* secured to the foundation wall 20. An adjustable hydraulic ram 54*b* is mounted between the bracket 54*a* and a rigid plate 54*c* (of typically about 2 feet square in size) firmly laying on the soil to ensure proper stability of the foundation wall 20 relative to the soil.

The hydraulic rams assemblies 54 are usually removed just prior the refill of the cavity adjacent the foundation wall. Obviously, during retrofitting, since the external wall surface 24 of the foundation walls 20 are open to the air, cracks 56 found into the foundation walls 20 can easily be repaired to prevent more damages thereof. Also, once the internal area 66 below the slab 12 has been drained, vent pipes 58 are typically installed at a few locations along the foundation wall 24, and extending through the footing 14 and up above the ground level G, to allow any pressurized gas, such as radon coming from underground and the like, to properly escape the area 66, on a continuous basis.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinafter claimed

I claim:

1. A method for keeping water away from an existing main concrete slab partially sitting on an edge of a top surface of an existing footing and adjacent an existing foundation wall sitting on the top surface of the existing footing, the existing footing having an external side surface facing away from the existing concrete slab and an internal side surface facing towards the existing concrete slab, said method comprising the steps of:

draining water away from an interior area located adjacent the internal side surface of the existing footing and below the existing concrete slab to an exterior area located adjacent the external side surface of the existing footing to keep water away from the existing concrete slab; by drilling at least one through hole extending through the existing footing from the internal side surface in fluid communication with the interior area to the external side surface in fluid communication with the exterior area, the at least one through hole sloping downwardly from the internal side surface to the external side surface;

installing at least one drain pipe along the at least one through hole of the existing footing from the internal side surface to the external side surface, and below the top surface, with the at least one drain pipe sloping downwardly from the internal side surface to the external side surface;

trimming an outer end of the at least one drain pipe extending away from the existing footing into the exterior area adjacent the external side surface; and installing a check valve at the outer end of the at least one drain pipe so as to prevent any solid or fluid from entering into the at least one drain pipe from the exterior area.

2. A method for keeping water away from an existing main concrete slab partially sitting on an edge of a top surface of an existing footing and adjacent an existing foundation wall sitting on the top surface of the existing footing, the existing footing having an external side surface facing away from the existing concrete slab and an internal side surface facing towards the existing concrete slab, said method comprising the steps of:

draining water away from an interior area located adjacent the internal side surface of the existing footing and below the existing concrete slab to an exterior area located adjacent the external side surface of the existing footing to keep water away from the existing concrete slab; by drilling at least one through hole extending through the existing footing from the internal side surface in fluid communication with the interior area to the external side surface in fluid communication with the exterior area, the at least one through hole sloping downwardly from the internal side surface to the external side surface; and installing a check valve inside the at least one through hole adjacent the external side surface so as to prevent any solid or fluid from entering into the at least one through hole from the exterior area.

3. The method of claim 1, wherein the at least one drain pipe includes a plurality of longitudinal sections connecting to each other into an end-to-end configuration, and wherein the step of installing at least one drain pipe includes:

axially inserting a first one of the plurality of longitudinal sections into the at least one through hole; and connecting a successive one of said plurality of longitudinal sections to a previously inserted one said longitudinal section into an end-to-end configuration, and axially inserting the successive one of the plurality of longitudinal sections into the at least one through hole.

4. A method for keeping water away from an existing main concrete slab partially sitting on an edge of a top surface of an existing footing and adjacent an existing foundation wall sitting on the top surface of the existing footing, the existing footing having an external side surface facing away from the existing concrete slab and an internal side surface facing towards the existing concrete slab, said method comprising the steps of:

draining water away from an interior area located adjacent the internal side surface of the existing footing and below the existing concrete slab to an exterior area located adjacent the external side surface of the existing footing to keep water away from the existing concrete slab; by drilling at least one through hole extending through the existing footing from the internal side surface in fluid communication with the interior area to the external side surface in fluid communication with the exterior area, the at least one through hole sloping downwardly from the internal side surface to the external side surface; and installing a vent pipe adapted to vent gas away from the interior area, the vent pipe extending from the interior area through the existing footing and along the existing foundation wall adjacent the external side surface to above a ground level adjacent the existing foundation wall.

* * * * *